US005931991A

United States Patent [19]

Leon

[11] Patent Number: 5,931,991

[45] Date of Patent: Aug. 3, 1999

[54] VACUUM CLEANER WITH SPONGE FILTER

[76] Inventor: Marty Gerard Leon, 18416 N. 31st Ave., Phoenix, Ariz. 85023-1124

[21] Appl. No.: 08/814,411

[22] Filed: Mar. 11, 1997

[51] Int. Cl.[6] ..... B01D 47/02

[52] U.S. Cl. ..... 96/250; 15/347; 15/353; 55/363; 55/473; 55/DIG. 3; 96/329; 96/337

[58] Field of Search ..... 55/DIG. 3, DIG. 2, 55/363, 250, 259, 223, 467, 315, 473; 95/214, 226; 15/347, 353

[56] References Cited

U.S. PATENT DOCUMENTS

| | | | |
|---|---|---|---|
| 2,499,876 | 3/1950 | Platek | 15/353 |
| 2,528,375 | 10/1950 | Lilly | 15/353 |
| 2,609,190 | 9/1952 | Jackson | 55/259 |
| 2,673,619 | 3/1954 | Martin | 15/353 |
| 2,909,800 | 10/1959 | Grindle et al. | 55/DIG. 3 |
| 3,082,465 | 3/1963 | Wood | 55/DIG. 3 |
| 3,431,582 | 3/1969 | Grave | 15/353 |
| 4,185,354 | 1/1980 | Brazier | 15/353 |
| 4,218,805 | 8/1980 | Brazier | 15/353 |
| 4,547,206 | 10/1985 | Sovis et al. | 55/DIG. 3 |
| 5,205,014 | 4/1993 | Yoo | 55/250 |
| 5,248,323 | 9/1993 | Stevenson | 55/DIG. 3 |
| 5,287,587 | 2/1994 | Yonkers et al. | 15/353 |
| 5,388,301 | 2/1995 | Bosyj et al. | 15/353 |
| 5,498,272 | 3/1996 | Leon | 55/DIG. 3 |

*Primary Examiner*—Duane S. Smith
*Attorney, Agent, or Firm*—John P. Halvonik

[57] ABSTRACT

An induction type of vacuum assembly for use with wet and dry vacuums is described. It includes a motor chamber; a solution chamber and a lower chamber for use inside of a canister that holds water and/or cleaning solution. A central chamber is inside of a solution tank and is in fluid connection with the lower chamber through a cage so as to prevent ingress of water into the motor assembly in the even that the level of the water rises. Foam filter(s) are used in connection with the cylindrical chamber so as to collect dirt and dirty water throughout the vacuuming operation.

3 Claims, 4 Drawing Sheets

VACUUM CLEANER WITH SPONGE FILTER

FIELD OF THE INVENTION

The invention relates to the field of vacuum cleaners and in particular an improved vacuum cleaner having some similarity to the applicant's previous patented wet/dry vac. U.S. Pat. No. 5,498,272 Mar. 12, 1996; where a foam filter element may be used atop the induction chamber and at the top of the assembled sections. The improved version of the foam filter assembly vacuum uses a foam filter element in that area between the upper chamber holding cleaning solution and the lower area that holds the float ball inside of a cylindrical chamber. Such filter element as described herein represents an improvement as this filter element goes on the outside of the assembly and around the cylinder elements where the suction effect is taking place.

The invention is believed to find most use in the field of wet and dry vacuums where the vacuum motor is designed to create a suction effect within the cylinder chamber of the lower housing. The invention uses a modular design that is believed to eliminate the need for an induction chamber and an hour glass shaped chamber that is seen in the applicant's previous vacuum cleaner referred to above. A spinning hub may be incorporated into the upper chamber as an additional option.

PRIOR ART

While there are wet/dry vacuums that are used in the prior art none of them that the applicant is aware of have a sponge filter elements in between the upper and lower chambers of in a wet dry vac that is of this design. That previous U.S. patent referred to above does use a foam filter however, such filter is shown at the center of the air induction assembly and is atop the induction chamber. That foam filter element used in this invention is shown as a filter element that goes beneath the circular shaped hub and is lateral to the induction area.

SUMMARY OF THE INVENTION

An induction type of vacuum assembly for use with wet and dry vacuums is shown herein. The assembly at a minimum comprises a motor chamber; a solution chamber and a lower chamber that are formed as an assembly of units one on top of the other. The assembly fits inside of a canister that holds water and/or cleaning solution. A central chamber is shown running inside of the solution tank and is in fluid connection with the lower chamber through a cage that extends downward from the solution tank and into the lower tank. A float ball is held within the cage so as to prevent ingress of water into the motor assembly in the event that the level of the water rises.

A curved section for holding a foam filter is formed by the union of the solution tank atop the lower chamber. Outer walls of the solution tank and lower chamber are of complimentary shape so that a toroidal shaped space is formed there and runs around the outside of the central cylindrical chamber. The foam filter(s) are used in connection with the cylindrical chamber so as to collect dirt and dirty water throughout the vacuuming operation. Ribs on the outside of the solution chamber further the fall of water from the outside of the solution tank and back down toward the lower chamber.

It is among the object of the invention to provide an improved induction canister assembly for wet dry vacuums that uses a foam filter element in order to more nearly connect dirt and other particles during the vacuuming operation.

Another object of the invention is to provide an induction type of wet dry vacuum that can dispense with the need to create an hour glass shaped induction assembly and also to use a foam filter in connection with such assembly that can eliminate the need to have a foam filter at the top center of the induction chamber.

Another object of the invention to provide an induction type of wet/dry vacuum having a canister that is of narrower size and can hold more water than previous designs.

Another object is to provide a solution tank member that would facilitate uses simiar to conventional vacuum assemblies.

Another object of the invention to provide an induction type of wet/dry vacuum that can hold a spinning hub and/or additional chambers so that the design is modular in nature and can be used in differing assemblies depending on the type of operation desired.

Other objectives will be apparent to those skilled in the art.

DESCRIPTION OF THE PREFERRED EMBODIMENT

Figure 1:
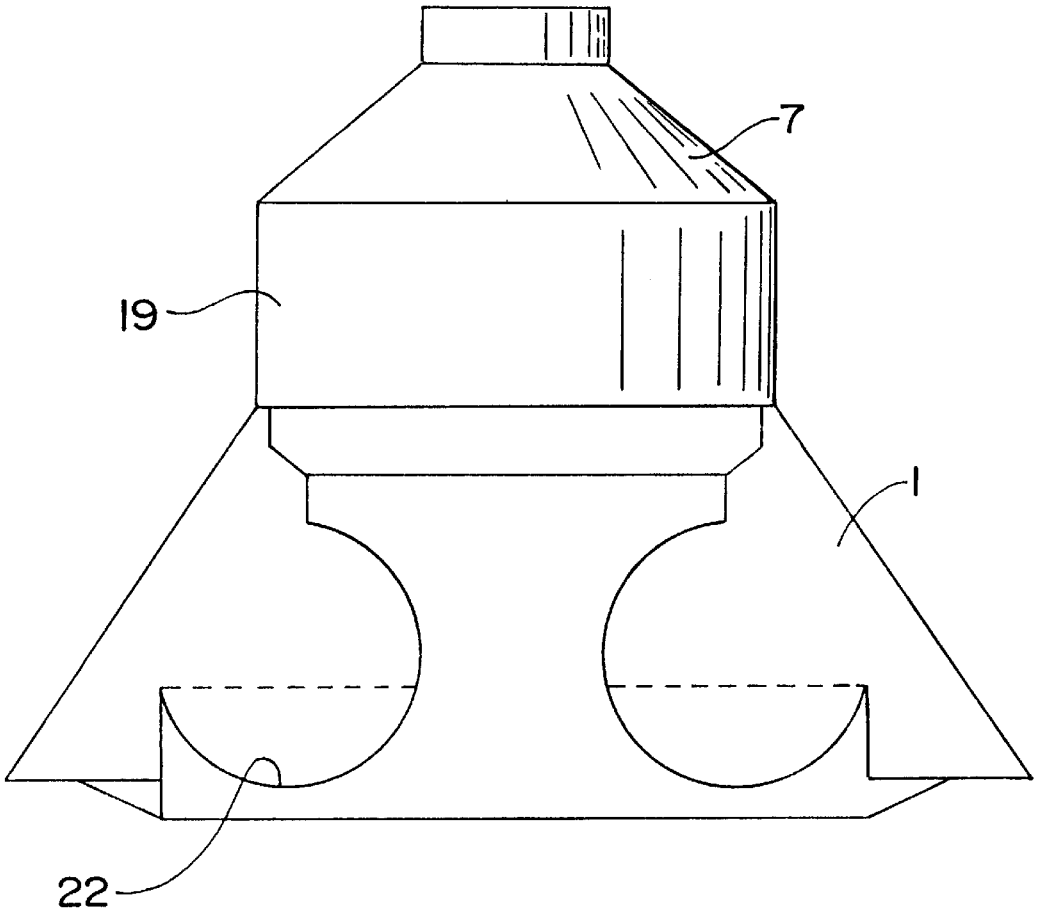
FIG. 1 Cross section of the assembly.

The overall assembly of the modular components is shown in FIG. 1. The lower chamber is at the bottom of the assembly. Such chamber should fit inside a vacuum canister that houses the entire assembly including a cleaning solution. The solution tank 19 is that section above the cylinder tank and will fit inside of the cylinder chamber 20.

Figure 6:
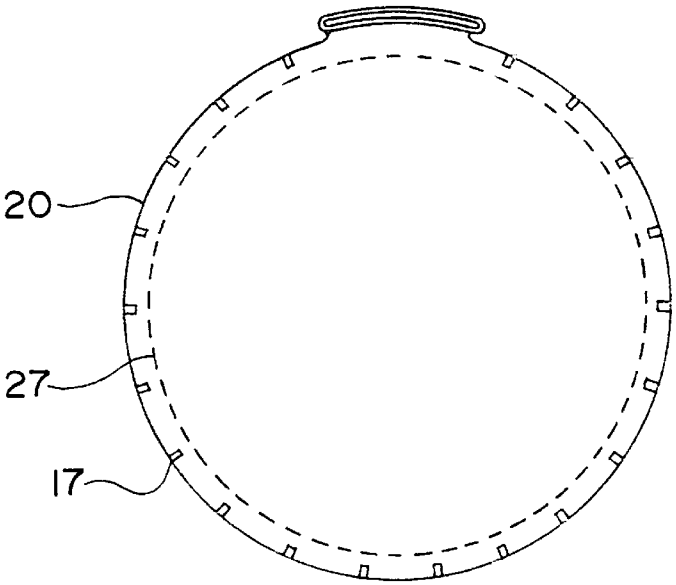
FIG. 6 top view of cylinder chamber showing "U" shaped channel.

Splines or ribs 17 may be used in connection with the inner walls of the cylinder chamber 20 (see FIG. 6) so that there will be a space formed between the outer wall of the solution tank and the inside of the wall of the cylinder chamber 20. Through the use of the spinning hub excess water can run down the outside of the solution tank and down into the foam band 27 and/or the lower chamber.

Figure 2:
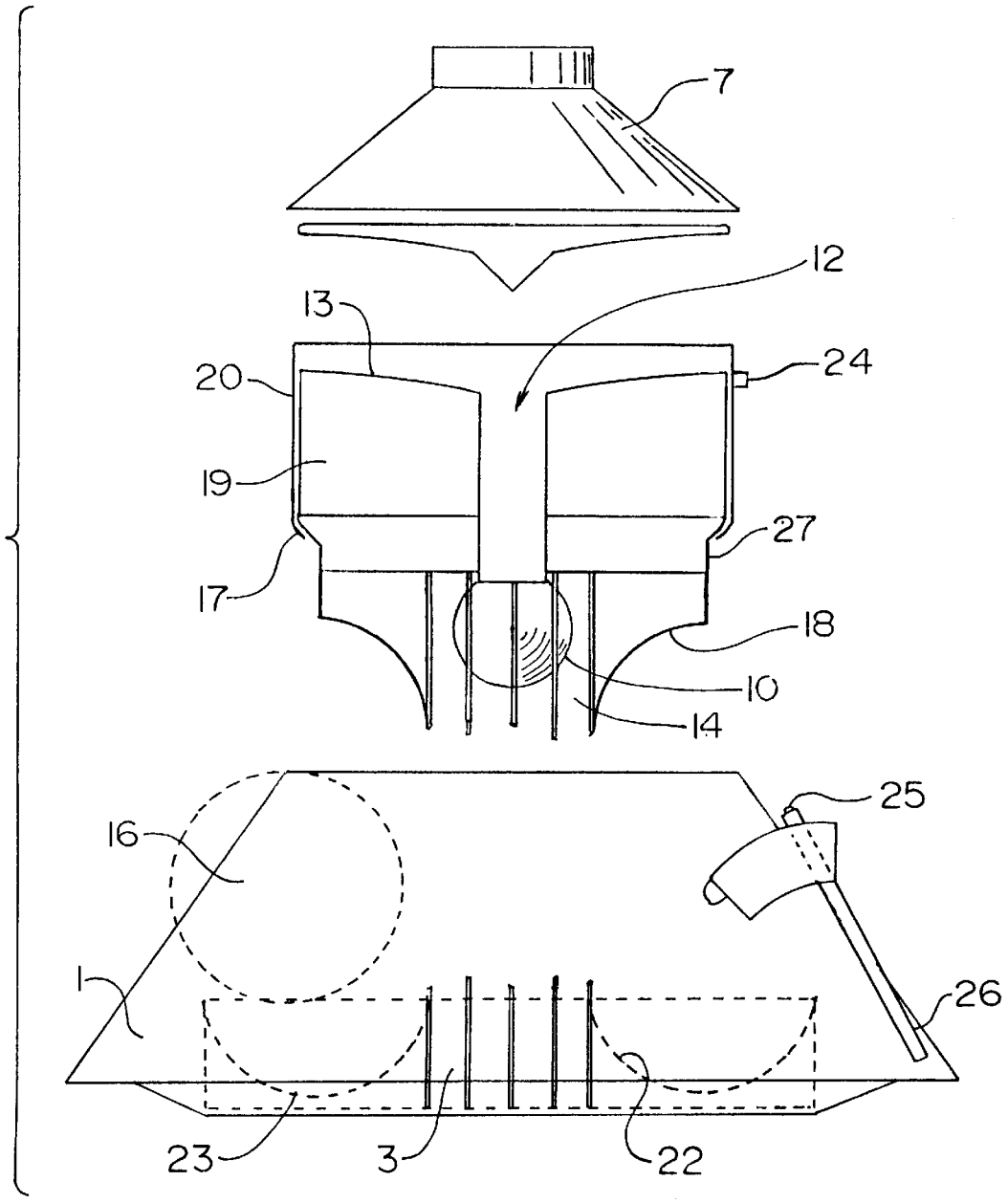
FIG. 2 another cross section showing cutaway of the solution tank and showing cylindrical central chamber.
Figure 5:
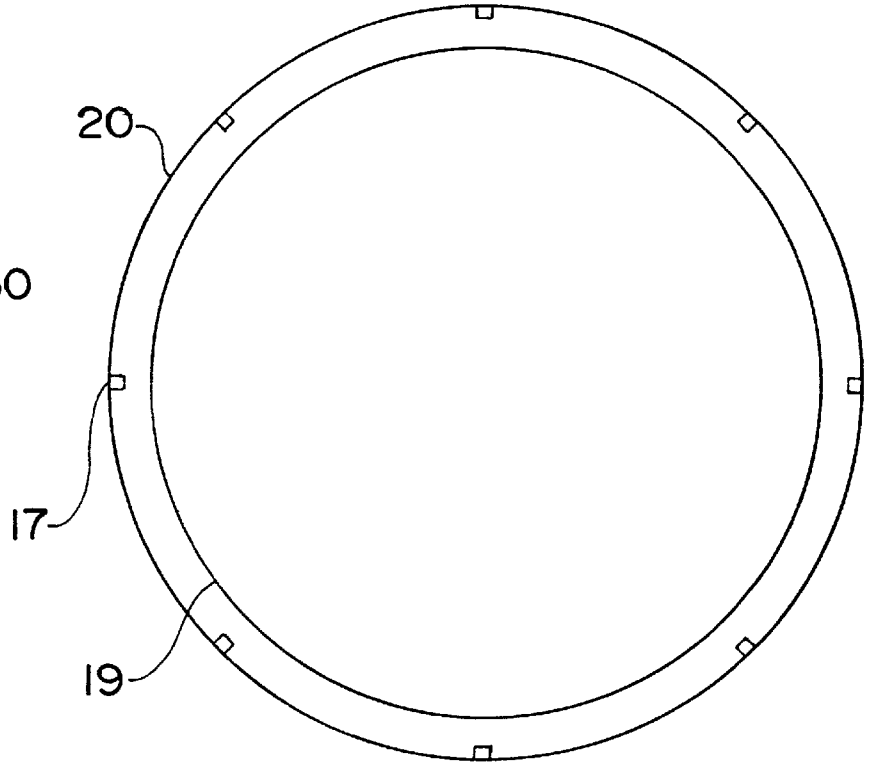
FIG. 5 top view of cylinder chamber.
Figure 3:
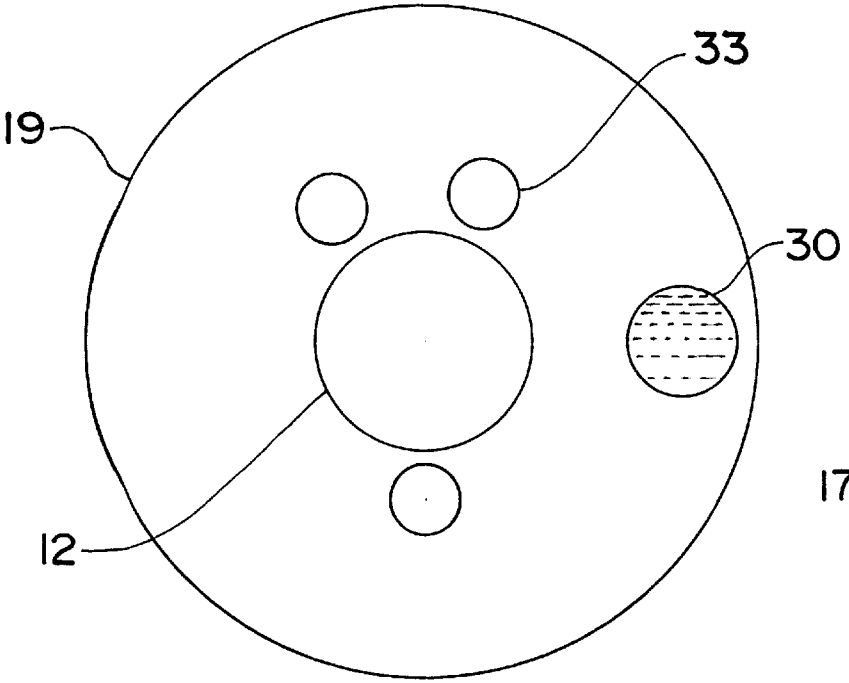
FIG. 3 top view of cylindrical chamber area showing slots and center orifice.
Figure 7:
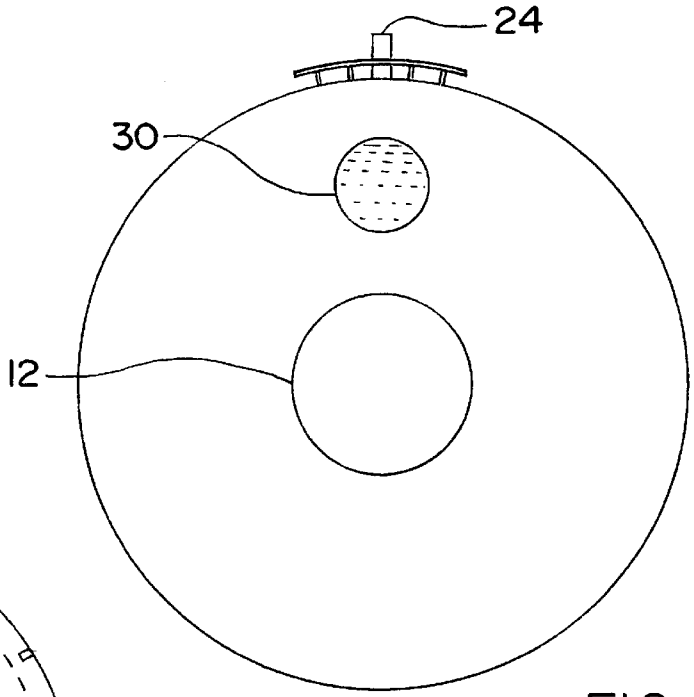
FIG. 7 top view of solution tank with spout.

Inside of the solution tank as seen in FIG. 2 is the cylindrical shaped central chamber 12. This chamber runs the entire distance from the top to the bottom of the solution tank and is in connection with the upper cage 14 and lower cage 3. It is preferred that the central chamber be about 2.5" in diameter but the invention is not restricted to such diameter. At the top of the tank, the central chamber 14 will be in close connection with the motor that is housed in the motor area 7. The motor creates the suction that draws air and dirt upward from the bottom of the cylinder tank and up through the central chamber.

When the solution chamber is placed atop the lower chamber in the manner shown in FIG. 2 the lower cage 14 will form a connection with upper cage 3. The cage is of open construction so as to permit the inlet of water. The float ball 10 will move up and down in the area formed by 3 and 14. Such area of the cage is of larger diameter than the central chamber and hence, the float ball can be made larger so that it cannot go into the central chamber.

When the suction effect is produced by the motor atop the central section the float ball will rise to the top of the cage 14. During the vacuum operation the movement of air upward through the central chamber will force the float ball to spin thus forcing water away from the central chamber and outward to the filter. The float ball will close this chamber to the inlet of water should the level of water and/or solution rise to a certain level inside of the lower chamber 1. Such raised level will force the float ball against the bottom of the central chamber and hence will act as a shut off to the inlet of water should the water level rise or the unit be tipped over.

The shape of the cylinder chamber is thus seen to be different from the induction chamber shown in the applicant's aforementioned U.S. patent. Such induction chamber in that invention is seen to have an hourglass shape and optional foam filter in that invention may be used at the top center of the induction assembly. Here the induction effect occurs in the central chamber 12 that has straight sides and is of cylindrical shape.

In the invention herein, the foam filter 18 should be placed around the cage assembly 14. The foam filter is contoured and extends from the bottom of the solution tank. When the upper cage 14 is placed atop the lower cage 3 there will be a curved wall formed by the wall sections of the foam elements 18 and 22. Wall section 22 extends outward from the periphery of the lower cage 3 to further the shape of the bag 16 and allow air to move underneath the bag 23. Together, the two sections 18 and 22 will form a roughly semi circular shaped wall (FIG. 1) that will support a similarly shaped bag 16 wherein during dry use that bag can be placed between the walls and inside of the lower chamber 1.

Figure 4:
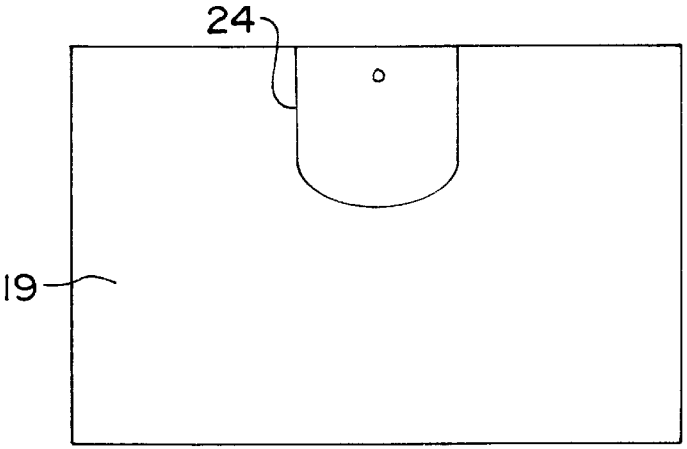
FIG. 4 Front view of solution tank showing "U" shaped spout.

Solution should be stored in the solution tank and through the use of a spout 24 (FIG. 4) will communicate the flow of liquid from the solution tank to various device such as carepet nozzles etc., or those devices generally associated with the use of cleaning solutions in such a manner that cleaning processes require. Also, within the use of this spout a tube 25 may be connected between the spout and the siphon inlet area near 25 so as to restore the evaporated water level disposed of in the main canister or lower chamber 1.

The lower chamber will contain water that is cycled during the wet operation. When the vacuum is in the wet filtration mode, the foam element 22 will serve to sift the larger dirt particles that would potentially travel back into the inlet nozzle 26 or central chamber 1. If a pump is added to the design in order to remove dirty water, etc. such pump would be on the outside with respect to the lower chamber and hence, the foam would act as a filter. In that event, the water would travel from area of the lower cage 3 and outward thus traveling through the foam element.

In the dry mode of operation, a bag may be substituted for the water or other cleaning solution and will be used in the same area.

The filter may be made of any suitable water absorbing material so as to collect excess water and prevent it from coming in connection with motor. It is preferred that the filters be of a semi circular nature so as to conform to the general toroidal shape seen by the union of walls 22 and 18. Such foam filter may be used and sold in sections that are complimentary to each other and comprise an upper and lower piece that fit upon one another. Two such half sections may be used to encircle the area of the lower cage 18 and 22. Apertures 33 may be added to the top of the solution tank to allow it to be lifted out by the user when it is desired to change solution, or the filter or other purpose.

As another option, a spinning hub may be used to separate water and/or dirt from the air or as a separate vacuuming stage between the motor housing 7 and the solution tank 5. The action of the hub may be so chosen so as to create another vacuum in addition to that created by the motor at the top of the assembly.

I claim:

1. An improved vacuuming assembly for wet and dry vacuums and for use inside of a vacuum canister having a motor, the assembly comprising the following: a lower chamber comprising an upper and a lower portion, each of said upper and lower portions having outer walls of shape complimentary to one another so that said outer walls will form a contoured surface of toroidal shape running along the outside of said lower chamber when said upper and lower portions are placed atop one another, said lower chamber further comprising a central passage of two parts, one of each part in connection with each of said upper and lower sections, said central passage thus forming a channel that runs inside of said upper and lower sections and is of open construction so as to permit the ingress of water and the raising and lowering of a float ball within said channel, an upper chamber having an outer chamber and a solution tank adapted for fitting within said outer chamber, said solution tank having an interior chamber running down through said solution tank so that said interior chamber will form a passage with said central passage when said upper chamber is placed upon said lower chamber, so that said passage will be in communication with a motor placed upon said upper chamber.

2. The apparatus of claim 1 having at least one foam element of circular shape and adapted for fitting upon said contoured surface.

3. The apparatus of claim 2 having a means to absorb moisture in connection with said solution tank.

* * * * *